United States Patent [19]

Malet et al.

[11] Patent Number: 4,727,652

[45] Date of Patent: Mar. 1, 1988

[54] CUTTING DEVICE FOR A CUTTING MACHINE, PARTICULARLY FOR CUTTING SOFT, STICKING OR DIRTYING MATERIALS

[75] Inventors: Jean-Claude Malet; Gérard Miachon, both of Venelles; Jean Regnier, Manosque, all of France

[73] Assignee: Commissariat a l'Energie Atomique, Paris, France

[21] Appl. No.: 865,854

[22] Filed: May 22, 1986

[30] Foreign Application Priority Data

May 30, 1985 [FR] France ..... 85 08137

[51] Int. Cl.[4] ..... B27B 17/02

[52] U.S. Cl. ..... 30/383; 83/168; 83/820

[58] Field of Search ..... 30/383–387; 83/168, 820, 830–834, 788

[56] References Cited

U.S. PATENT DOCUMENTS

| | | | |
|---|---|---|---|
| 2,921,613 | 1/1960 | Silvey | 30/387 |
| 3,613,749 | 10/1971 | Geurian | 83/830 |

FOREIGN PATENT DOCUMENTS

| | | | |
|---|---|---|---|
| 1185943 | 1/1965 | Fed. Rep. of Germany | 83/788 |
| 2302610 | 1/1973 | Fed. Rep. of Germany . | |
| 2445226 | 4/1976 | Fed. Rep. of Germany | 83/830 |
| 1548796 | 12/1967 | France . | |
| 371252 | 7/1961 | Switzerland . | |

*Primary Examiner*—Frank T. Yost
*Assistant Examiner*—Hien H. Phan
*Attorney, Agent, or Firm*—Kerkam, Stowell, Kondracki & Clarke

[57] ABSTRACT

A cutting device for a cutting machine comprises a chain guided in translation along a cutting plane by a chain guide and has cutting tools arranged alternately on either side of the cutting plane. Each cutting tool has a curved cutting end, which curves towards the outside of the cutting plane and defines a concave surface. A scraper is positioned on either side and in the vicinity of the chain guide and cutting tools parallel to the cutting plane, said scraper having two ends projecting towards said plane, each having a convex surface complementary to the concave surface, so that said ends remove cutting waste from the tools during the passage of the tools on the scraper. The cutting device is especially useful for cutting soft, sticking, or dirtying materials.

2 Claims, 3 Drawing Figures

CUTTING DEVICE FOR A CUTTING MACHINE, PARTICULARLY FOR CUTTING SOFT, STICKING OR DIRTYING MATERIALS

BACKGROUND OF THE INVENTION

The present invention relates to a cutting device for a cutting machine and is used more particularly for cutting soft, sticking or dirtying materials, such as a soft metal, sodium, plastics materials, etc.

The cutting machines generally used for cutting soft materials have cutting devices of the type shown in cross-section in FIG. 1. This device comprises a chain 2 having links 4 guided in translation by a chain guide 6, following a cutting plane perpendicular to the plane of the drawing.

Each link 4 has a side plate 8, 10 located on either side of the cutting plane. Two successive links 4 are connected by a connecting link 12 located between side plates 8, 10. A spindle 14 pivotably connects side plates 8, 10 and the corresponding connecting link 12. The latter projects towards the chain guide 6 and is slidingly located in a U-shaped surface formed in said chain guide 6, so that the chain is guided in translation.

Side plates 8, 10 are extended opposite to the chain guide 6, so as to in each case form a cutting tool 16, 18 respectively. Each cutting tool has a curved cutting end, which curves towards the inside of the cutting plane. On cutting a soft, sticking or dirtying material with such a cutting device, cutting waste accumulates in the space 20 formed between the cutting tools 16, 18. Such waste ends up as a mass in front of the cutting end of the cutting tools, so as to greatly reduce the cutting efficiency of the chain and can even lead to the chain jamming in the material to be cut.

One solution would be to provide a scraper, e.g. fixed to the chain guide, able to clean cutting waste from space 20. However, such an arrangement is impossible, because the scraper would be located on the path of the cutting tools and would consequently prevent their movement.

Other cutting arrangements have also been proposed comprising links equipped with cutting tools, whose end projects towards the outside of the cutting plane, the attachment part to the link being located on the latter in the case of a chain whose guidance links are also used for supporting the cutting tools, as in the case of No. CH-A-371 252, or curved in towards the cutting plane when the cutting links are displaced with respect thereto, as in No. FR-A-1 548 796 and U.S. Pat. No. 3,613,749. Thus, the concavity of the section of the cutting tools is oriented towards the outside of the cutting plane, unlike in FIG. 1.

The tools curved in in this way are justified by the wish to obtain a regular, gentle cut, or a smooth-bottomed slot or groove. They are not expressly designed for the materials to which the present invention relates and no special device for cleaning the tools is provided.

SUMMARY OF THE INVENTION

The present invention aims at solving this problem by proposing a cutting device for a cutting machine, particularly for cutting soft materials, comprising a chain guided in translation along a cutting plane by a chain guide and having cutting tools alternately arranged on either side of the cutting plane, each cutting tool having a curved, cutting end curved towards the outside of the cutting plane and defining a concave surface, wherein a scraper, located on either side and in the vicinity of the chain guide and cutting tools parallel to the cutting plane, has two ends projecting towards said plane, each having a convex surface complementary to said concave surface, so that said ends remove cutting waste from said tools during the passage of the tools on the scraper.

Advantageously, an elastic system is interposed between the chain guide and the scraper, so that the latter can apply its two ends with a certain force against the cutting tools.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
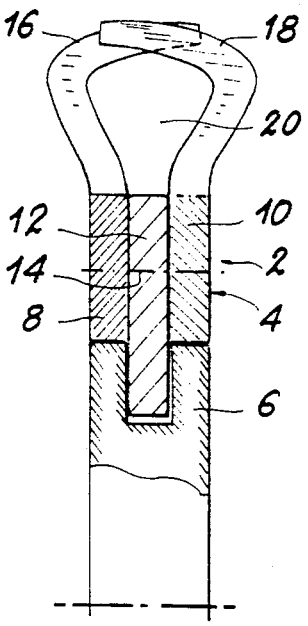
FIG. 1 (PRIOR ART)
FIG. 1: Already described, in cross-section, a prior art cutting device.
Figure 2:
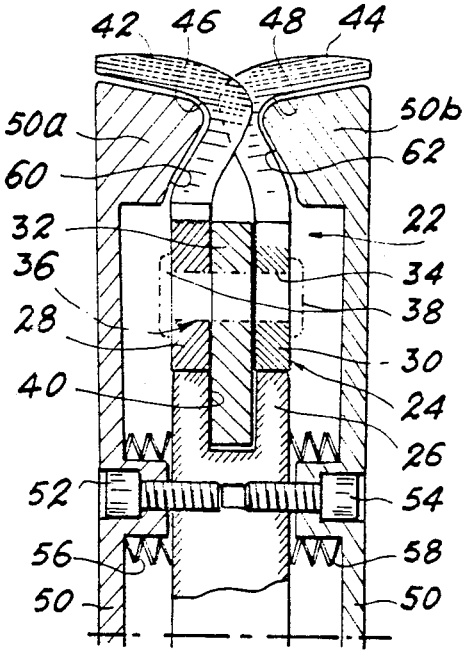
FIG. 2: In cross-section, a preferred embodiment of the cutting device according to the invention.
Figure 3:
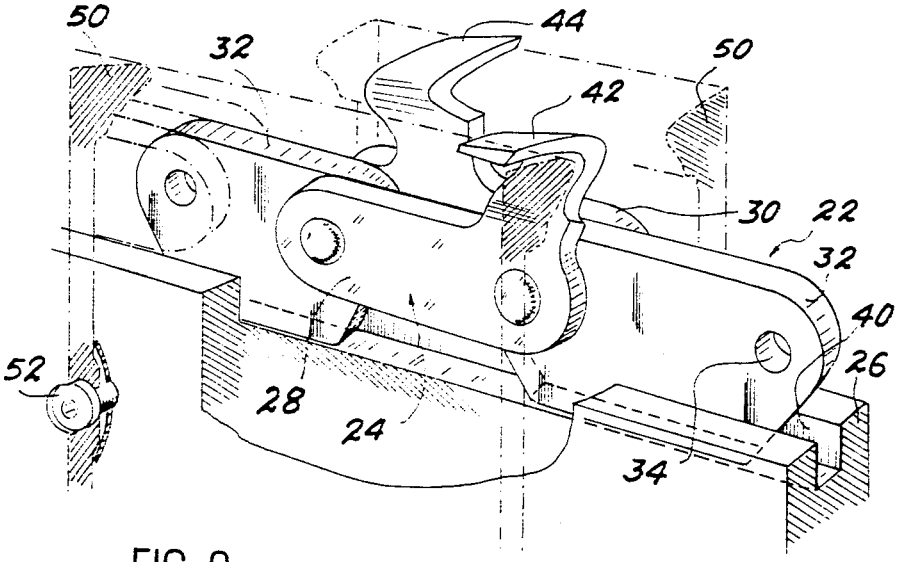
FIG. 3: In perspective, part of the cutting device.

A preferred embodiment of the cutting device according to the invention will now be described with the aid of FIGS. 2 and 3. The cutting device firstly comprises a chain 22, formed by links 24, guided in translation along a cutting plane perpendicular to the plane of FIG. 2 by a chain guide 26.

Each link 24 comprises a pair of side plates 28, 30 arranged on either side of the cutting plane. Two successive links 24 are connected by a connecting link 32 interposed between said side plates 28, 30. A hole 34 is made transversely in each of the connecting links 32 and in each of the side plates 28, 30 in the vicinity of the longitudinal ends thereof. A spindle 36 is located in each of the holes 34, so as to pivotably mount the connecting links 32 between side plates 28, 30 of each of the links, in such a way that links 24 and connecting links 32 form chain 22.

The connecting links 32 are extended towards the chain guide 26. The thus projecting portions of the connecting links 32 can be located in a U-shaped section 40 formed in chain guide 26 symmetrically with respect to the cutting plane. When the chain performs a translatory movement, said section 40 guides the connecting links 32 and consequently chain 22, so that said movement takes place in the cutting plane.

Side plates 28, 30 are extended opposite to the chain guide 26 so as to in each case form a cutting tool 42, 44 respectively. According to the invention, each cutting tool 42, 44 has a curved cutting end, which curves towards the outside of the cutting plane and defines a concave surface 46, 48 respectively.

A scraper 50 is located on either side of chain 22 and chain guide 26. Scraper 50 is fixed to chain guide 26, e.g. by two screws 52, 54, located on either side of guide 26, so that there is a clearance between scraper 50 and chain guide 26. Two tension springs 56, 58 are positioned coaxially to said screws 52, 54 between chain guide 26 and scraper 50.

The two ends 50*a*, 50*b* of scraper 50 located on either side of the cutting tools 42, 44 project towards the cutting plane, whilst defining two convex surfaces 60, 62 complementary to said concave surfaces 46, 48.

The two springs 56, 58 make it possible to apply the two ends **50*a*, 50*b* of the scraper with a certain force against the cutting tools 42, 44. Thus, said two ends 50*a*, 50*b*** can remove the cutting waste from the tools during the passage of the latter on the scraper.

Thus, the cutting waste can no longer accumulate between the cutting tools as was the case with the prior art and consequently such a cutting device always operates under satisfactory conditions. There is no longer any risk of the chain jamming in the material to be cut.

Obviously the above description has only been given in an exemplified manner and all constructional modifications can be envisaged without modifying the fundamental principle of the invention.

For example, it is possible to envisage different shapes for the cutting tools, the scraper then having corresponding complementary shapes. It would also be possible to arrange cutting tools on the chain connecting links. In the same way, the chain could be formed by a flexible belt guided in translation by a chain guide and having fixed cutting tools on either side of said belt. It is for this reason that the word "chain" designates any equivalent system, such as a belt.

What is claimed is:

1. A cutting device for a cutting machine, particularly for cutting soft materials, comprising a chain guided in translation along a cutting plane by a chain guide with two sides and having cutting tools alternately arranged on either side of the cutting plane, said cutting plane defining an outside, each cutting tool having a curved, cutting end curved towards the outside of the cutting plane and defining a concave surface, two scrapers, each scraper located on one of the two sides of the chain guide and having an end, each end projecting towards said cutting plane and having a convex surface complementary to said concave surface, so that said ends remove cutting waste from said tools during the passage of the tools on the scraper.

2. A cutting device according to claim 1, wherein an elastic system is interposed between the chain guide and the scraper, in such a way that the latter can apply its two ends against the cutting tools with a certain force.

* * * * *